US006688754B1

(12) United States Patent
Wu

(10) Patent No.: US 6,688,754 B1
(45) Date of Patent: Feb. 10, 2004

(54) FLEXIBLE DECORATION LIGHT STRING AND METHOD FOR PREPARATION THEREOF

(76) Inventor: Jeng-Shyong Wu, No. 14, Alley 1, Lane 326, Shyr-Piin Rd., Hsin-Chu City (TW)

( * ) Notice: Subject to any disclaimer, the term of this patent is extended or adjusted under 35 U.S.C. 154(b) by 64 days.

(21) Appl. No.: 09/713,792

(22) Filed: Nov. 15, 2000

(51) Int. Cl.[7] ..... F21V 21/00
(52) U.S. Cl. ..... 362/249; 362/267
(58) Field of Search ..... 362/267, 249, 362/251, 252, 227, 235, 236, 237

(56) References Cited

U.S. PATENT DOCUMENTS 4,143,411 A * 3/1979 Roberts ..... 362/145
4,521,839 A * 6/1985 Cook et al. ..... 362/238
4,812,956 A * 3/1989 Chen ..... 362/249
5,934,792 A * 8/1999 Camarota ..... 362/249
6,217,194 B1 * 4/2001 Huang ..... 362/249

* cited by examiner

*Primary Examiner*—Sandra O'Shea
*Assistant Examiner*—James W Cranson, Jr.
(74) *Attorney, Agent, or Firm*—McGlew and Tuttle, P.C.

(57) ABSTRACT

A flexible decoration light string comprising multiple luminaries being connected with multiple electrical conductors in series, parallel or series and parallel to form rectangular lighting strings, by means of insulator along with said rectangular lighting strings under the way of longitudinal direction to contain and seal the luminaries and the electrical conductors within in said insulators, thus the luminaries and the electrical conductors being isolated to outside to form a flexible decoration lighting strings, then one or both ends of said strings connected to the connectors to form a circuit loop.

12 Claims, 18 Drawing Sheets

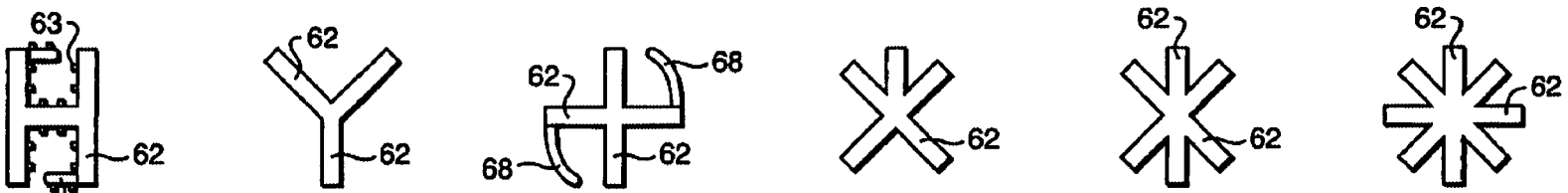
FIG. 8A
FIG. 8B
FIG. 8C
FIG. 8D
FIG. 8E
FIG. 8F
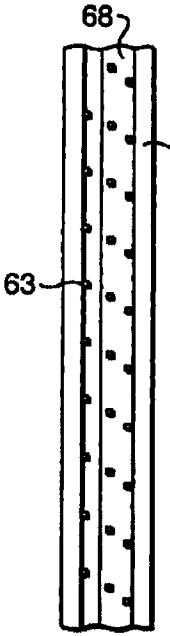
FIG. 8A-1
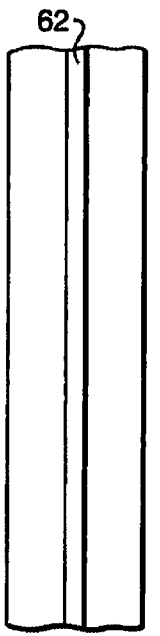
FIG. 8B-1
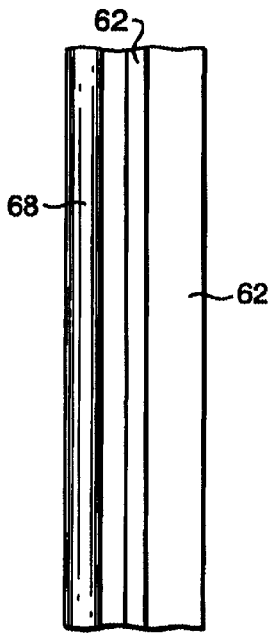
FIG. 8C-1
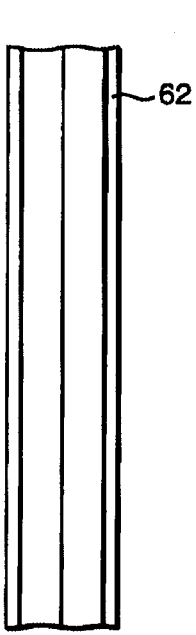
FIG. 8D-1
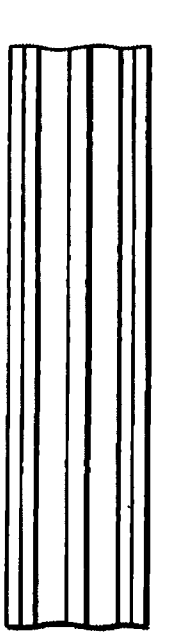
FIG. 8E-1
FIG. 8F-1

FLEXIBLE DECORATION LIGHT STRING AND METHOD FOR PREPARATION THEREOF

BACKGROUND OF THE INVENTION

The present invention generally relates to a flexible decoration light string and a method for the preparation of said light string, more particularly relates to a flexible decoration light string to be sealed in an insulator (or insulating body) and method for preparation of it.

The decoration light string is generally used around a tree, window or door, or pre-arranged on a decorative sheet or a stand. Some of the transitional light strings are arranged on a three-dimensional body. However, such conventional light strings are not any variances. Further, the conventional light strings are easily to be damaged due to net any protection on them and easily caused short circuit.

The present invention relates to a flexible decoration light string comprising multiple luminaries being connected with multiple electrical conductors in series, parallel or series and parallel to form rectangular lighting strings, by means of insulator along with said rectangular lighting strings under the way of longitudinal direction to contain and seal the luminaries and the electrical conductors within in said insulators, thus the luminaries and the electrical conductors being isolated to outside to form a flexible decoration lighting strings, then one or both ends of said strings connected to the connectors to form a circuit loop.

SUMMARY OF THE INVENTION

The purpose of the present invention is to provide a flexible decoration light string comprising multiple luminaries being connected with multiple electrical conductors in series, parallel or series and parallel to form rectangular lighting strings, by means of insulator to seal the luminaries and the electrical conductors within in said insulators, thus the luminaries and the electrical conductors being isolated to outside to form a safety of flexible decoration lighting strings.

The present invention is also to provide a method for the preparation of a flexible decoration light string comprising to string connection of multiple luminaries with multiple electrical conductors to form a circuit loop of a light string; to combine single loop light strings in series or parallel to form a single or multiple circuit loops of rectangular light string.

The further purpose of the present invention is to provide positioning devices having fixed article to fix electrical conductors and luminaries in a certain position in order to present them being best to cause from short circuit.

The further purpose of the present invention is to provide the use of plastic extruder to make a rectangular light string to be sealed within the insulating plastic via predetermined die of said extruder to form flexible decoration light string with outward insulating body.

Other objects, effect and features will become apparent when the description of preferred embodiments is taken in conjunction with the annexed drawings.

BRIEF DESCRIPTION OF THE DRAWINGS

FIG. 1 is showing a flexible decoration light string with single loop light string of the present invention.

FIG. 2 is showing a flexible decoration light string with single loop light string or multi-loops light string of present invention; FIG. 2C is D—D line;

FIG. 3 is showing another type of flexible decoration light string of the present invention; FIG. 3C is B—B line;

FIG. 4 is showing further type of flexible decoration light string of the prevent invention; FIG. 3A is single loop light string.

FIG. 5 is showing a flexible decoration light string with thermosetting tube.

FIG. 6 is showing a flexible decoration light string with adhesive tape.

FIG. 7 is showing a further type of light string of the present invention.

FIG. 8 is showing positioning devices in a flexible decoration light string of the present invention; FIG. 8A is showing a cross-section view of spacer; FIG. 8A-1 is showing a front view of spacer of FIG. 8A; FIG. 8B is showing a cross-section view of another spacer; FIG. 8B-1 is showing a front view of spacer of FIG. 8B; FIG. 8C is showing a cross-section view of a further spacer; FIG. 8C-1 is showing a cross-section view of FIG. 8C; FIG. 8D is showing a cross-section view of a further spacer; FIG. 8D-1 is showing a cross-section view of FIG. 8D; FIG. 8E is showing a cross-section view of a further spacer; FIG. 8E-1 is showing a cross-section view of FIG. 8E; FIG. 8F is showing a cross-section view of a further spacer; FIG. 8F-1 is showing a cross-section view of FIG. 8F;

FIG. 9 is showing a connector in the flexible decoration light string of the present invention.

FIG. 10 is showing a flexible decoration light string with connectors of the present invention; FIG. 11 is a perspective view of flexible decoration light strings with insulator.

DESCRIPTION OF PREFERRED EMBODIMENTS

Figure 1A:
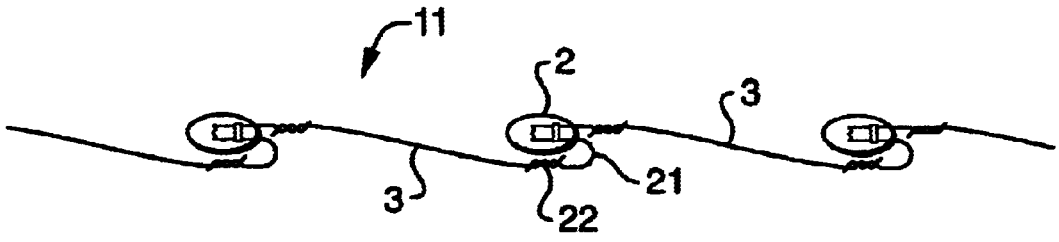
FIGS. 1A–1D are showing the connections with luminaries and electrical conductor.

The prevent invention relates to a flexible decoration light string comprising multiple luminaries being connected with multiple electrical conductors in series, parallel or series and parallel to form rectangular lighting strings, by means of insulator along with said rectangular lighting strings under the way of longitudinal direction to contain and seal the luminaries and the electrical conductors within in said insulators, thus the luminaries and the electrical conductors being isolated to outside to form a flexible decoration lighting strings, then one or both ends of said strings connected to the connectors to form a circuit loop.

The present invention also relates to a method for the preparation of a flexible decoration light string, comprising: (1) to string connection: multiple luminaries connected multiple electrical conductors to form a circuit loop of a light string; (2) to combine together: single loop light string being connected in series or parallel to form a single or multiple circuit loops of rectangular light strings; (3) to extrude mould: to use plastic extruder to make the rectangular light string in the longitudinal direction to be sealed within the insulting plastic via predetermined die of said extruder to form flexible decoration light string with outward insulating body.

Further, the products of the present invention can be flexible. When the flexible decoration light string of present invention is used, it expands to form a large and three-dimensional structure of a pretty decoration light string. When the flexible decoration light string is in non-use, it can be received within a small volume for the convenience of package, transportation and storage. Thus the products produced according to the present invention are able to provide a highly economic and safe device.

Figure 1B:
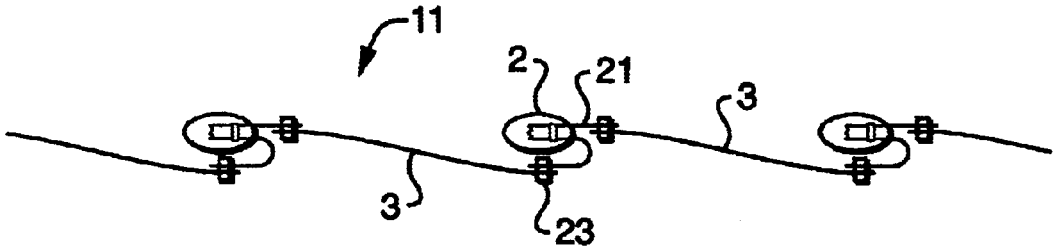
Figure 1C:
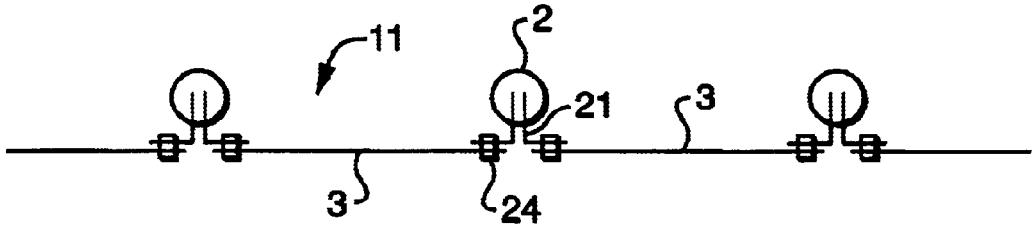
Figure 1D:
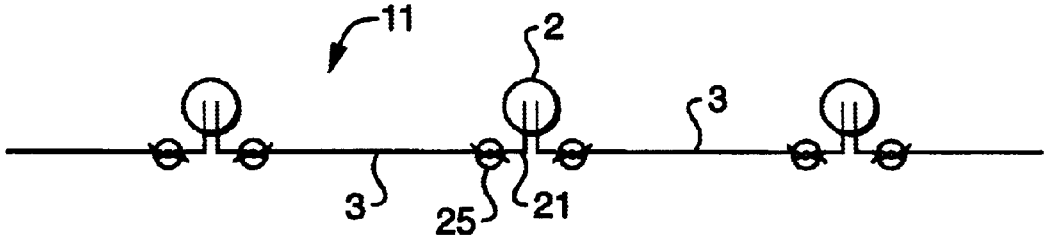

The present invention provides for different combination on the basis of different assemblies. Each combination is suitable to a different usage, place and effect to obtain the desired safety. In order to understand the present invention completely, the descriptions are done for the preferred embodiments shown in the drawings:

Now referring to FIGS. 1, 1A–1D, these drawings show a flexible decoration light string with single loop light string of the present invention. FIG. 1A is an assembly of luminaries 2 and electrical conductor 3 in a single loop light string 11 of light string 1, in which the luminaries 2 via extendable conducting wire 21 are twisted and wound with electrical conductor 3 at twisted winding 22. FIG. 1B is another assembly of luminaries 2 and electrical conductor 3 in a single loop light string 11, in which the luminaries 2 via extendable conducting wire 21 are welded with the electrical conductor 3 at welding 23. FIGS. 1C–1D are further assemblies of luminaries 2 and electrical conductor 3 as the same as in FIG. 1B, but at pressure press 24 and at twisted winding and re-welding 25 respectively.

Figure 2A:
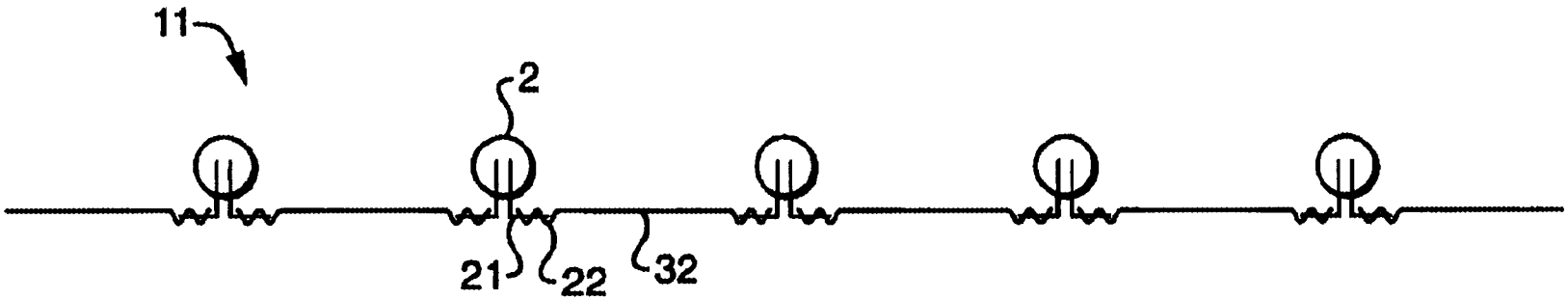
FIG. 2A is showing the connection of luminaries and electrical conductor in single loop light string.
Figure 2B:
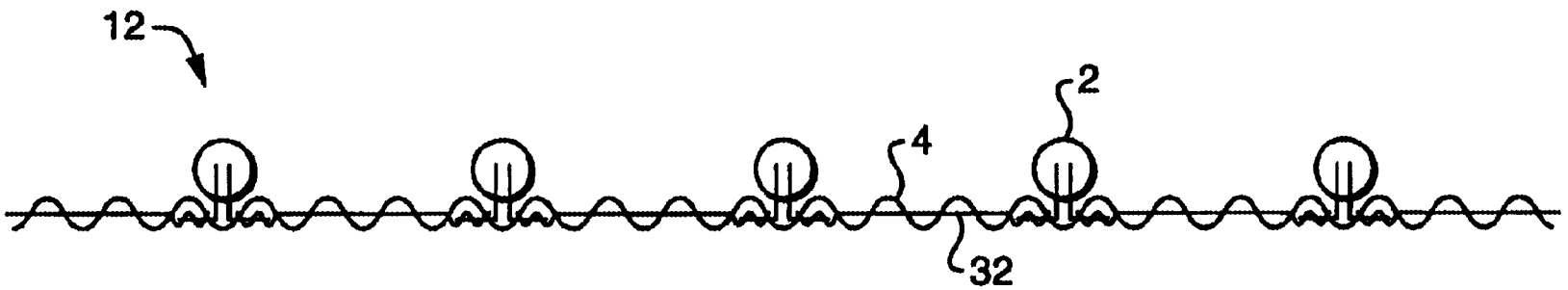
FIG. 2B is showing the non-electrical connector twisted winding the electrical conductor.
Figure 2C:
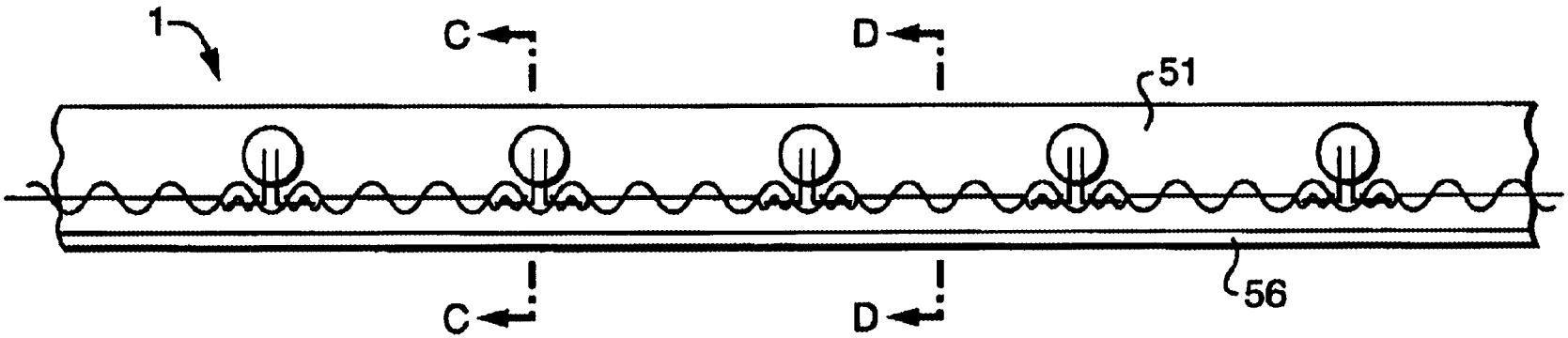
FIG. 2C is showing a flexible decoration tight string within an insulator.
Figure 2D:
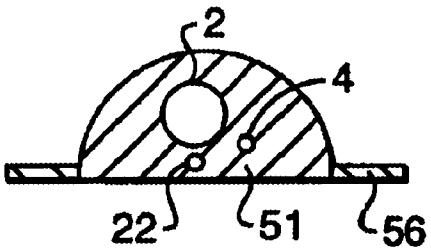
FIG. 2D is showing a cross-section view of FIG. 2C is C—C line.
Figure 2E:
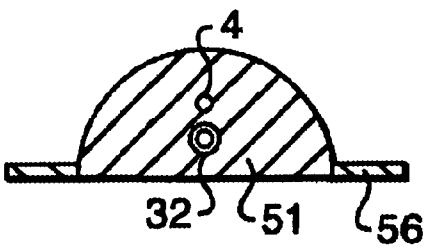
FIG. 2E is showing a cross-section view

FIGS. 2, 2A–2D are showing a flexible light string with single loop light string 11 or multi-loops light string 12 within an insulator 5. FIG. 2A is an assembly of luminaries 2 and open copper lead wire 32 in a single loop 11 of light string 1, in which the luminaries 2 via extendable conducting wire 21 are twisted and wound with open copper lead wire 32 at twisted winding 22. FIG. 2B is the same as in FIG. 2A, but the open copper lead wire 32 being twisted and wound with a non-electrical connector 4. FIG. 2C is showing a flexible decoration light string 1 to be sealed in an insulator 5, in which said insulator 5 is solid 51 and having a fringe 56. FIG. 2D is a cross-section view of FIG. 2C in C—C line, in which the insulator 5 is semi-circular 55 with solid 51 and having fringe 56 on both sides. The luminary 2 is placed at the center and the twisted winding 22 below it and non-electrical connector 4 being near said twisted winding 22. FIG. 2E is a cross-section view of FIG. 2C in D—D line, in which the insulator 5 is solid 51 and the fringe 56 on both side of said insulator. Further, the open copper lead wire 32 and non-electrical connector 4 are at the center of said insulator.

Figure 3A:
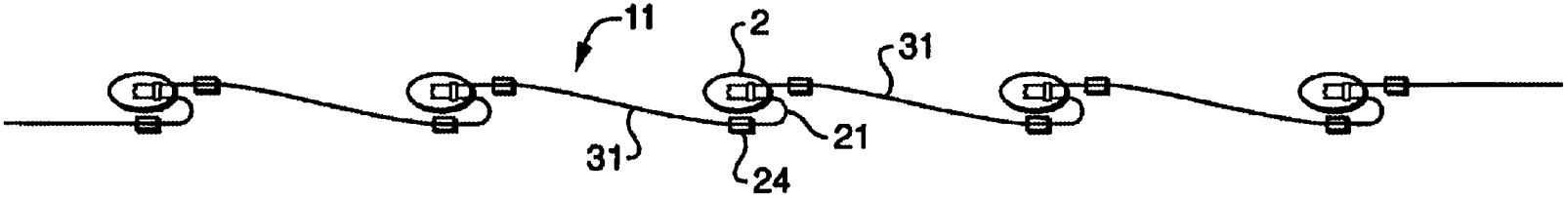
FIG. 3A is showing the connection of luminaries and electrical conductor in single loop light string.
Figure 3B:
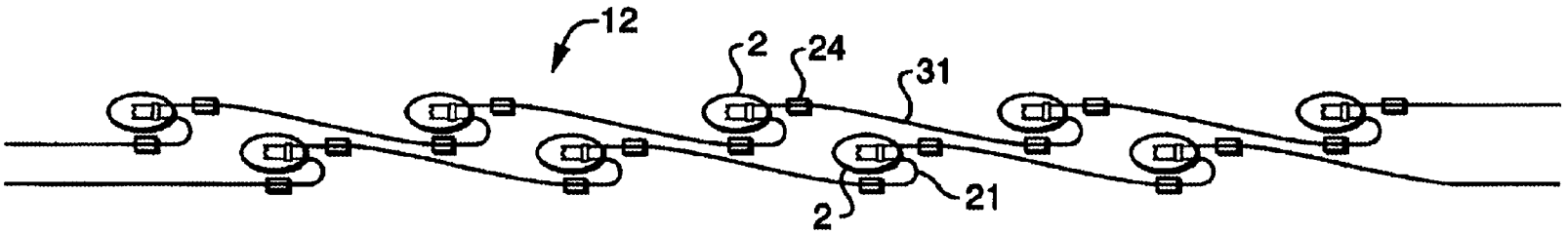
FIG. 3B is showing the non-electrical connector twisted winding the electrical conductor.
Figure 3C:
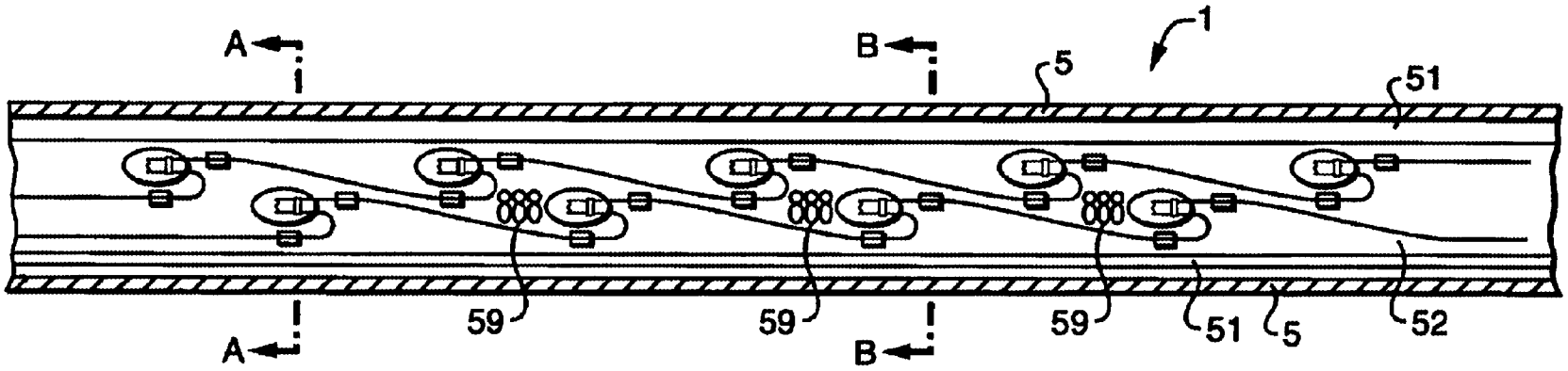
FIG. 3C is showing a flexible decoration tight string within an insulator.
Figure 3D:
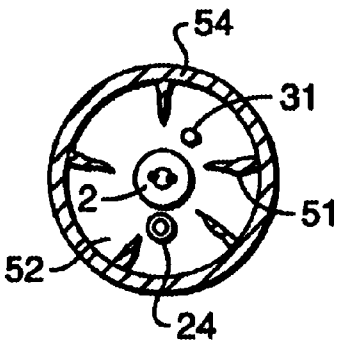
FIG. 3D is showing a cross-section view of FIG. 3C is A—A line.
Figure 3E:
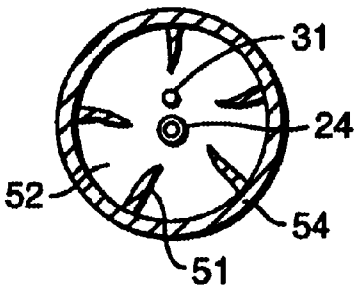
FIG. 3E is showing a cross-section view

FIGS. 3, 3A–3E are showing another type of flexible decoration light string 1 with single loop light string 11 or multi-loops light string 12 within an insulator 5. FIG. 3A is an assembly of luminaries 2 and insulating conducting wire 31 in a single loop 11 of light string 1, in which the luminaries 2 via extendable conduction wire 21 are welded with insulating conducting wire 31 at pressure press 24. FIG. 3B is showing assemblies of luminaries 2 and insulating conducting wire 31 in multi-loops of light string 1. The structure of FIG. 3B is the same as in FIG. 3A. FIG. 3C is showing a flexible decoration light string 1 to be sealed in an insulator 5, in which said insulator 5 is solid 51 and having reflectors 59. FIG. 3D is a cross-section view of FIG. 3C, A—A line, in which the insulator 5 is circular 54 with solid 51 and having hollow 52 inside the circular 54 of the insulating body 5. The luminary 2 is placed at the center and the pressure press 24 below it and the insulating conducting wire 31 being above the luminaries 2. FIG. 3E is a cross-section view of FIG. 3C in B—B line in which the insulator having solid 51 and hollow 52 inside said insulator. Further, the insulating conducting wire 31 and the welding 24 are at the center of said insulator 5.

Figure 4A:
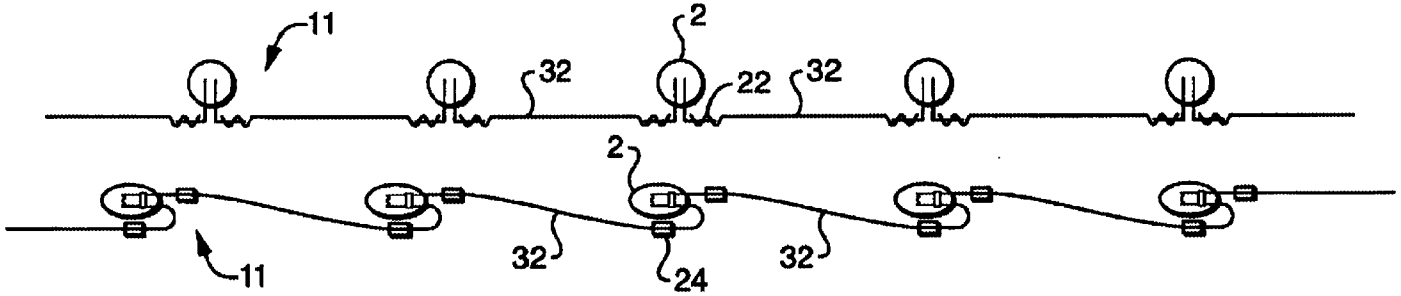
FIG. 4A is showing the combination of FIG. 2A
Figure 4B:
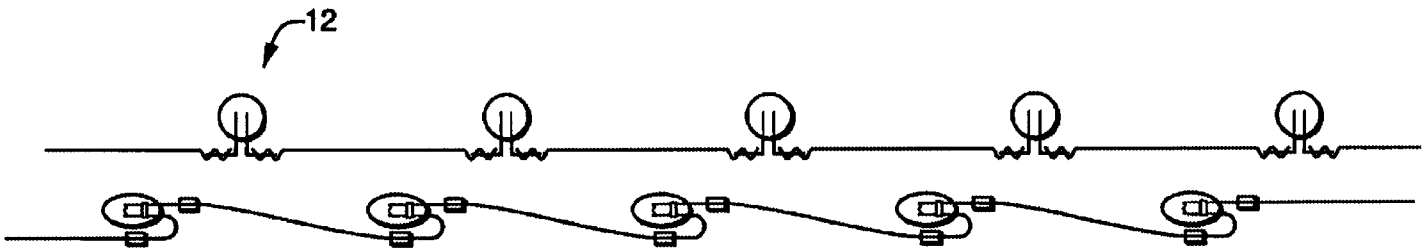
FIG. 4B is showing the light string same as FIG. 4A is multi-loops light string.
Figure 4C:
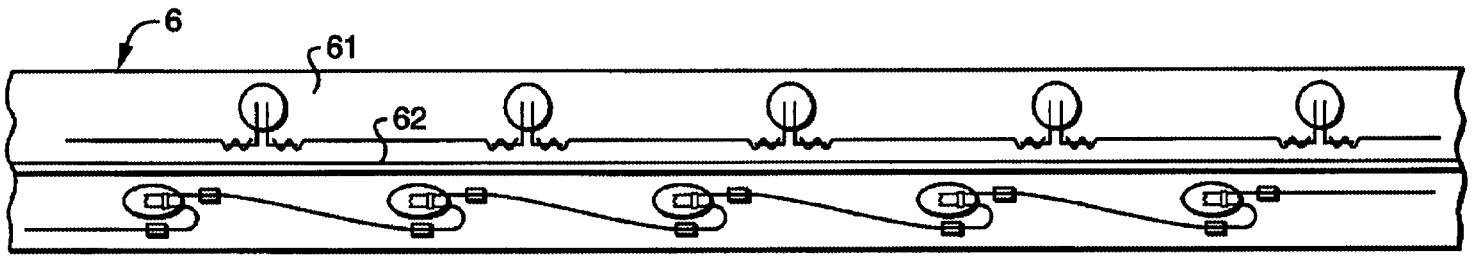
FIG. 4C is showing a flexible decoration light string within positioning device with spacer.
Figure 4D:
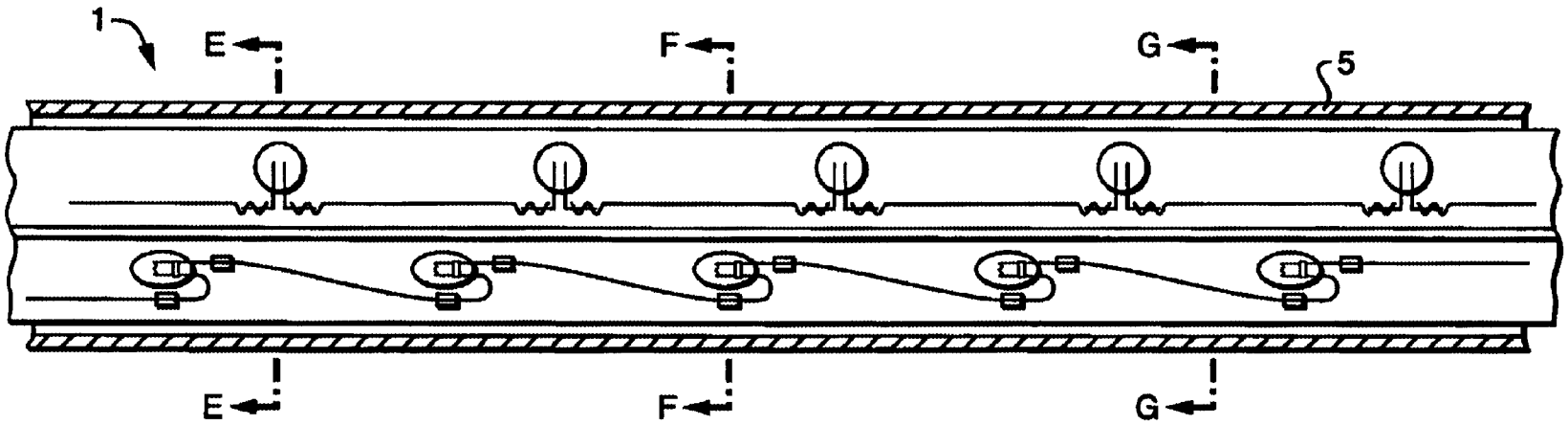
FIG. 4D is showing a flexible decoration light string of FIG. 4C within an insulator.
Figure 4F:
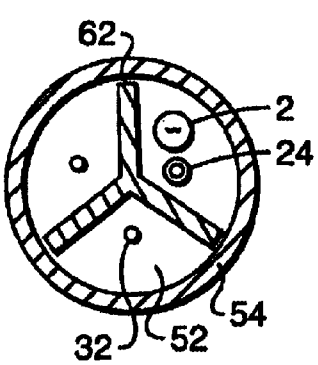
FIG. 4F is showing a cross-section view of FIG. 4D in F—F line.
Figure 4E:
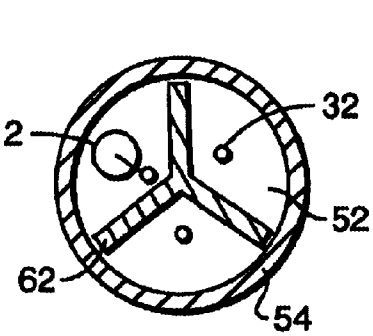
FIG. 4E is showing a cross-section view of FIG. 4D in E—E line.
Figure 4G:
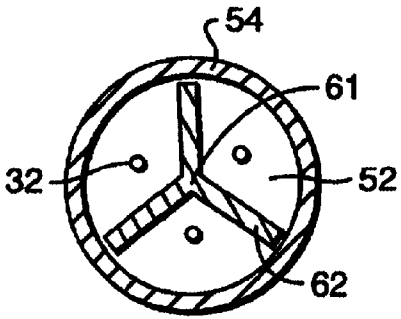
FIG. 4G is showing a cross-section view of FIG. 4D is G—G line.

FIGS. 4, 4A–4G are showing a further type of flexible decoration light string 1 in single loop light string 11 or multi-loops light string 12 within an insulator 5. FIG. 4A is assemblies of two different kinds of light strings, in which the luminaries 2 via extendable conducting wire 21 are connected to open copper lead wire 32 at twisted winding 22 and pressure press 24 receptively. FIG. 4B is the same as in FIG. 4A, but the light string are multi-loops light string 12. FIG. 4C is showing the flexible decoration light strings to be fixed by using a positioning device 6, in which said positioning device 6 has a spacer 62 and spaced bars 61. The spacer 62 and spaced bars 61 are used to separate the flexible decoration light strings 1 in order to prevent light strings from short circuit. FIG. 4D is showing the flexible decoration light strings 1 to be sealed in an insulator 5. FIG. 4E is a cross-section view of FIG. 4D in E—E line, in which the insulator 5 is circular 54 with hollow 52 and having a Y form spacer 62 to separate flexible decoration light strings 1. The luminary 2 in a light string is placed at one side of Y form spacer 62 and the open copper lead wire 32 in another light string is placed at another side of said spacer 62. FIG. 4F is a cross-section view of FIG. 4D is F—F line, in which the insulator 5 is circular 54 with hollow 52 and having a Y form spacer 62 to separate flexible decoration light strings 1. The luminary 2 with pressure press 24 in a light string is place at one side of Y form spacer 62 and the open copper lead wire 32 in another light string in placed at another side of said spacer 62. FIG. 4 G is a cross-section view of FIG. 4D in G—G line. The structure is the same as FIG. 4F, in which the open copper lead wires 32 are separated by the spacer 62.

Figure 5A:
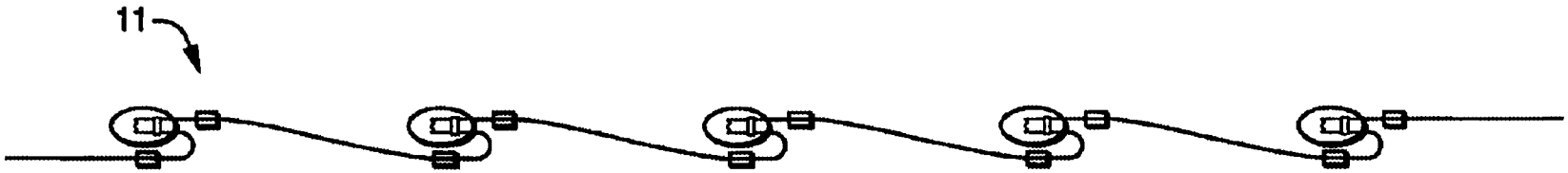
FIG. 5A is showing a single loop light string.
Figure 5B:
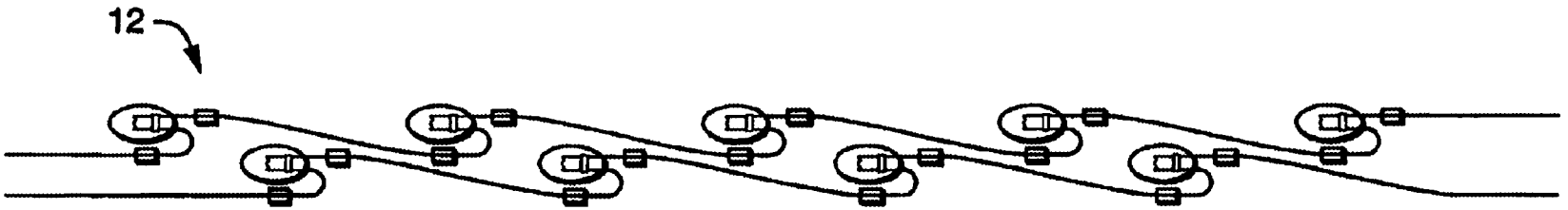
FIG. 5B is showing multi-loops light string.
Figure 5C:
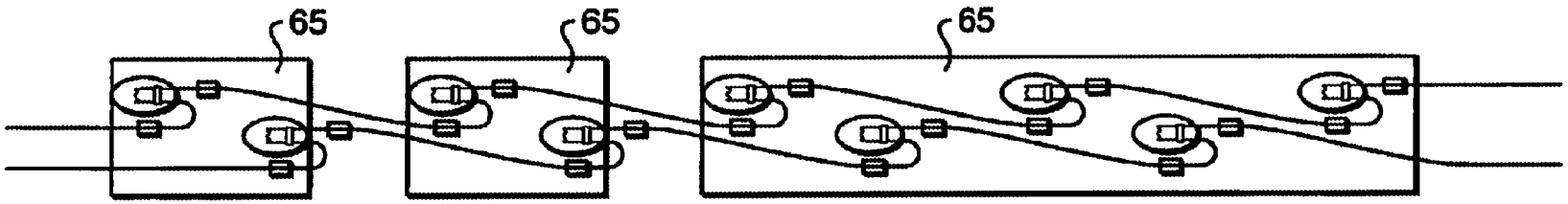
FIG. 5C is showing a flexible decoration light string with thermosetting tube.
Figure 5D:
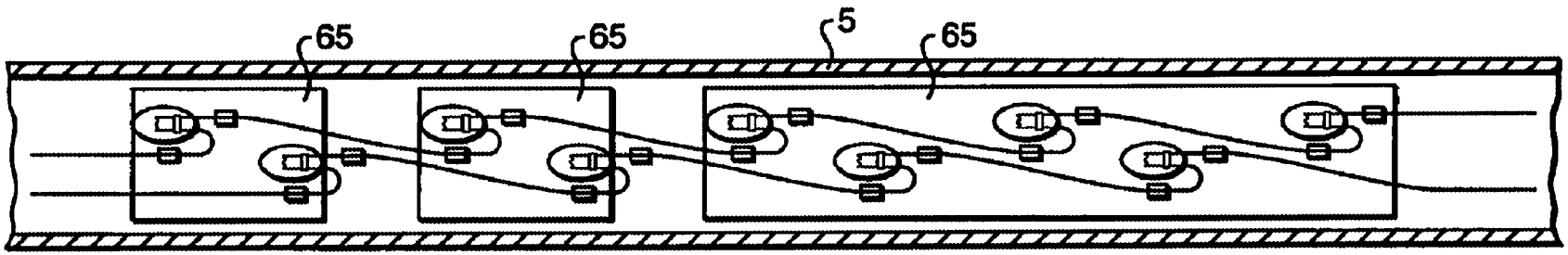
FIG. 5D is showing a flexible decoration light string of FIG. 5C within an insulator.
Figure 6A:
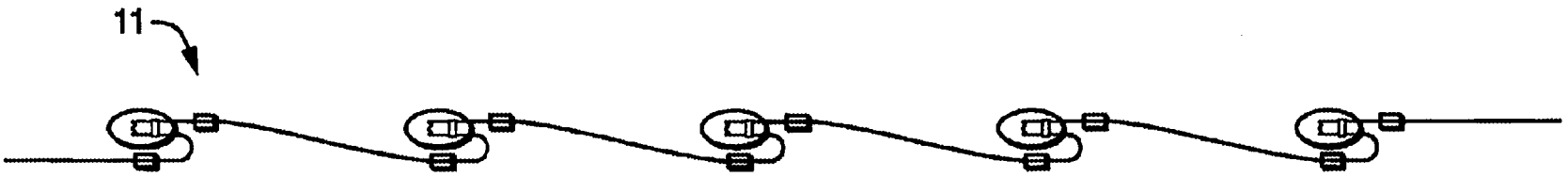
FIG. 6A is showing a single loop light string.
Figure 6B:
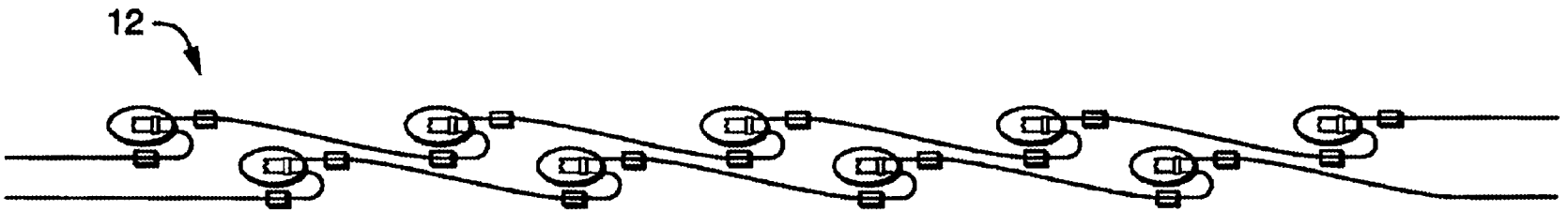
FIG. 6B is showing multi-loops light string.
Figure 6C:
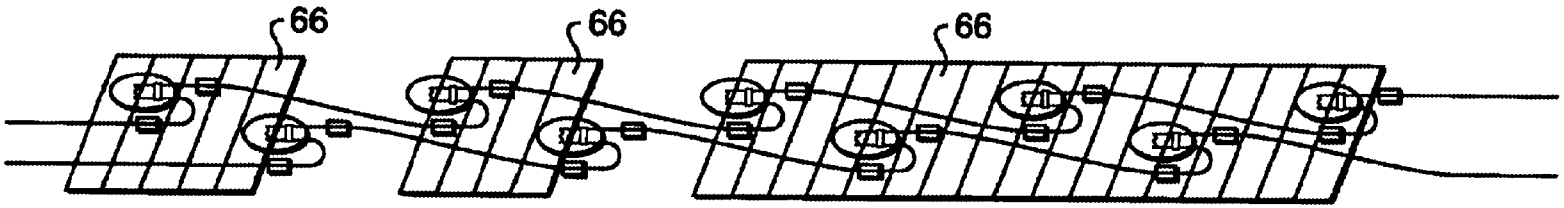
FIG. 6C is showing a flexible decoration light string with adhesive tape.
Figure 6D:
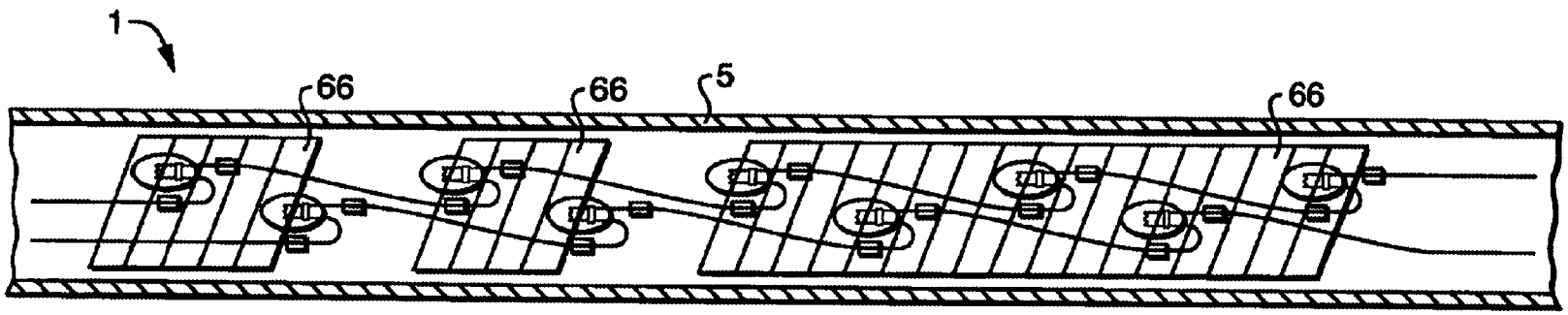
FIG. 6D is showing a flexible decoration light string of FIG. 6C within an insulator.

FIGS. 5, 5A–5E are showing a further type of flexible decoration light string 1 in single loop light string 11 or multi-loops light string 12 within thermosetting tube (sleeve) 65 in an insulator 5. FIG. 5A is showing an assembly of a flexible decoration light string 1 with a single loop light string 11. FIG. 5B is showing assemblies of flexible decoration light strings 1 with multi-loops light string 12. FIG. 5C is showing flexible decoration light strings 1 within thermosetting tube 65, in which the thermosetting tubes 65 are able to adjust their length freely. FIG. 5D is showing the structure of flexible decoration light strings 1 in FIG. 5C to be sealed in an insulator 5, in which the thermosetting tube 65 are the relative places within said insulator 5.

FIGS. 6, 6A–6D are showing a further type of flexible decoration light string 1 in single loop light string 11 or multi-loops light strings 12 sealed by adhesive tape 66 in an insulator 5. The structures of FIGS. 6, 6A–6D are same as those of in FIGS. 5, 5A–5D, but the adhesive 66 being instead of thermosetting tube 65.

Figure 7A:
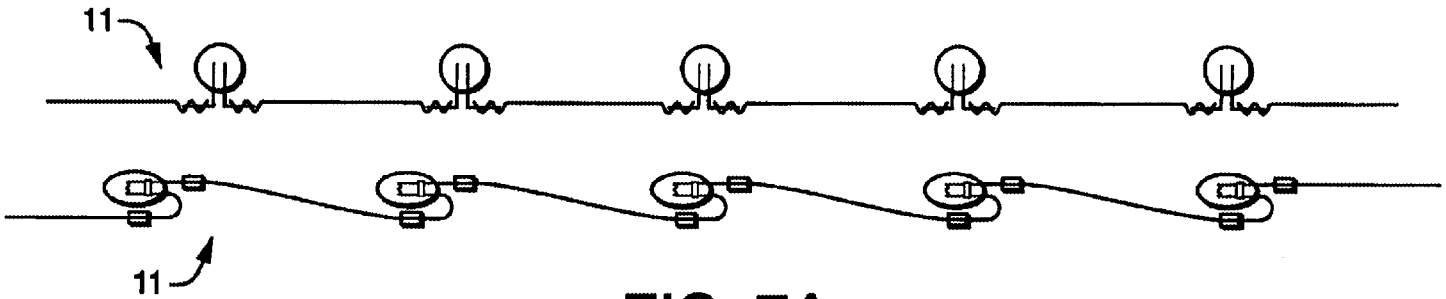
FIG. 7A is showing a combination of FIG. 2A and FIG. 3A in single loop light string.
Figure 7B:
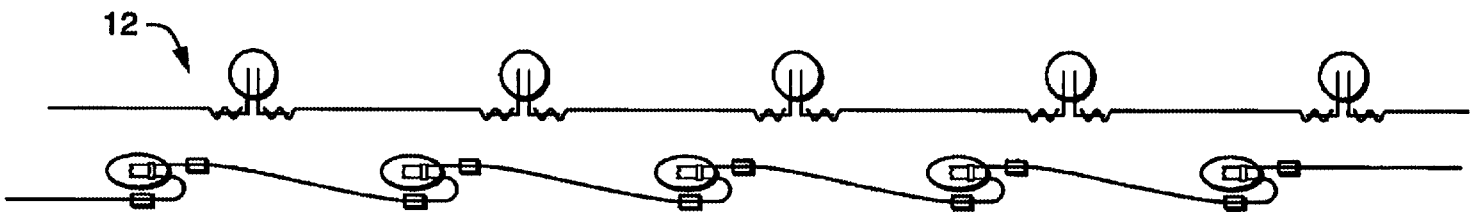
FIG. 7B is showing the light string same as FIG. 7A in multi-loops light string.
Figure 7C:
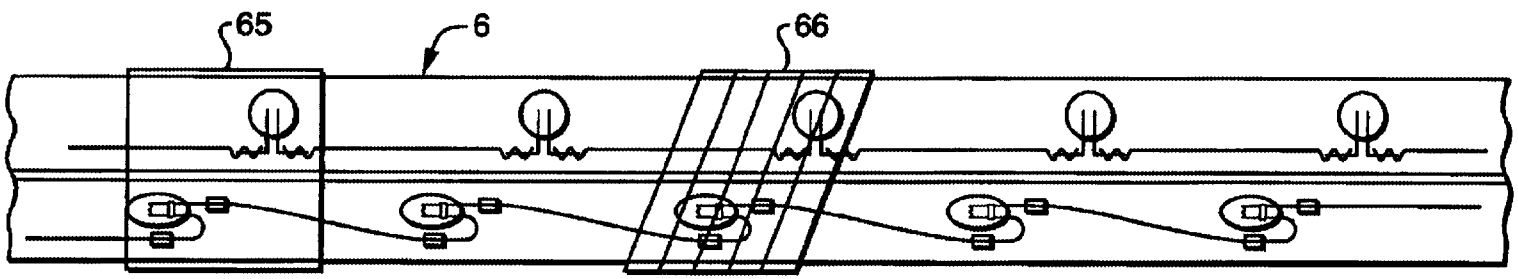
FIG. 7C is showing a flexible decoration light string with thermosetting tube and adhesive tape.
Figure 7D:
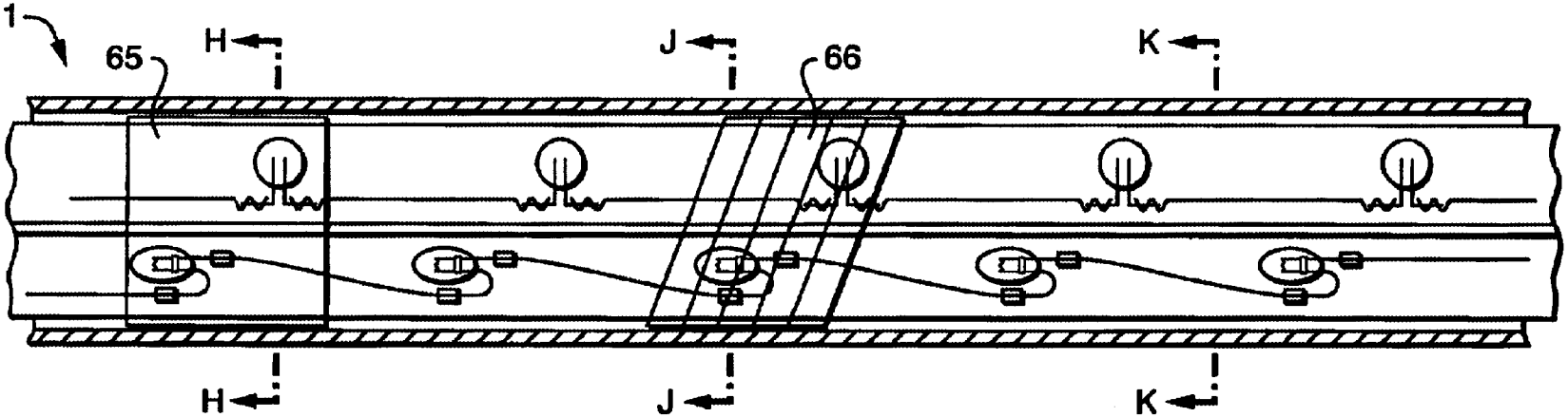
FIG. 7D is showing a flexible decoration light string of FIG. 7C within an insulator.
Figure 7F:
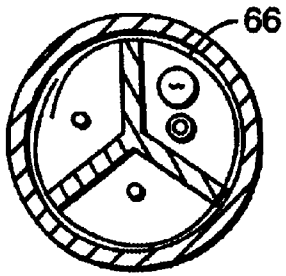
FIG. 7F is showing a cross-section view of FIG. 7D in J—J line.
Figure 7E:
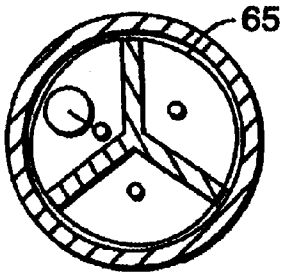
FIG. 7E is showing a cross-section view of FIG. 7D in H—H line.
Figure 7G:
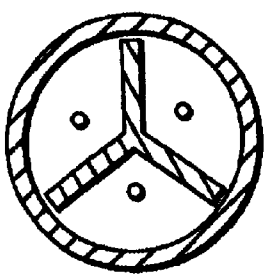
FIG. 7G is showing a cross-section of FIG. 7D in K—K line.

FIGS. 7, 7A–7G are showing further type of flexible decoration light strings 1 in single loop light string 11 or multi-loop light string 12 with thermosetting tube 65 and adhesive tape 66 in the insulator 5. The structures in FIGS. 7A and 7B are the same as those of in FIGS. 4A and 4B. The structures in FIGS. 7C and 7D are the same as those of in FIGS. 4C and 4D, in which the differences are that there are thermosetting tube 65 and adhesive tape 66 in FIGS. 7C and 7D. The structure of FIG. 7E is identical with that of in FIG. 4E, in which there is a thermosetting tube 65 to seal the light strings 1. FIG. 7F is a cross-section view of FIG. 7D in J—J line. The structure of FIG. 7F is identical with that of in FIG. 4F, in which there is an adhesive tape 66 to seal the light strings 1. FIG. 7G is a cross-section view of FIG. 7D in K—K line. The structure of FIG. 7G is identical with that of in FIG. 4G.

FIGS. 8, 8A–8F, 8A-1 to 8F-1 are showing positioning devices 6 to be used to separate the light strings 1. FIG. 8A is showing a cross-section view of H from of spaced bar 61, in which spacer 62 is used to separate the light strings 1 and inner wall of said spacer 62 is to form convex and concave spacer 63. One end of spacer 62 in the upper part has a spacer fringe 68 to be used as fixed article. FIG. 8A-1 is showing a longitudinal direction of said spaced bar 61 of FIG. 8A. FIG. 8B is showing a cross-section view of Y form of spaced bar 61. FIG. 8B-1 is showing a longitudinal direction of aid spaced bar 61 of FIG. 8B. FIG. 8C is showing a cross-section view of + form of spaced bar 61. Both ends of the spacers 62 in the horizontal direction have spaced fringe 68 to be used as fixed article. FIG. 8C-1 is showing a longitudinal direction of said spaced bar 61 of FIG. 8C. FIG. 8D is showing a cross-section view of ★ form of spaced bar 61. FIG. 8D-1 is showing a longitudinal direction of said spaced bar 61 of FIG. 8D. FIG. 8F is showing a cross-section view of ∗ form of spaced bar 61. FIG. 8F-1 is showing a longitudinal direction of said spaced bar 61 of FIG. 8F.

Figure 9A:
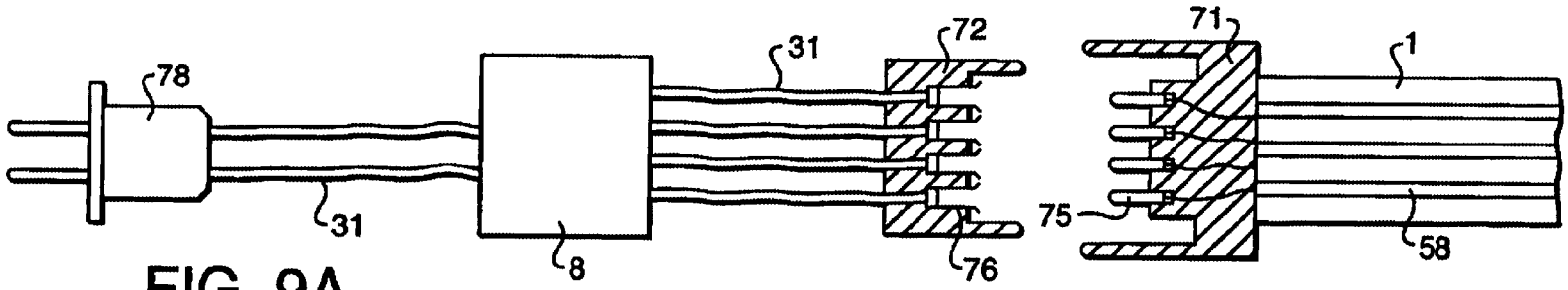
FIG. 9A is showing an exploded view of connector in the flexible decoration light string of the present invention.
Figure 9B:
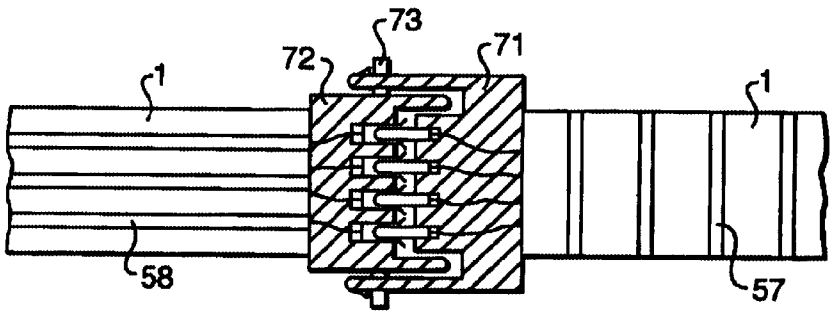
FIG. 9B is showing a fastening status of the connector.
Figure 9C:
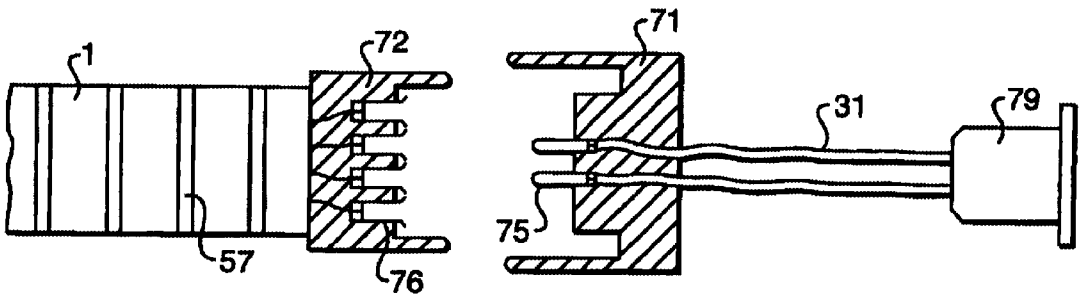
FIG. 9C is showing an exploded view of another connector of the present invention.

FIGS. 9, 9A–9C are showing a connector 7 in the flexible decoration light string 1 of the present invention. FIG. 9A is showing an exploded view of a connector 7 in a light string 1, in which an electrical plug 78 via insulating conducting wire 31 is connected to a function controller 8 and said function controller 8 via insulating conducting wire 31 connect to a connector 7. The connector 7 has two parts of male part 71 and female part 72, in which there are male connecting terminal 75 and female connecting terminal 76 respectively. FIG. 9B is showing a fastening status of the connector 7 of two light strings, in which a female part 72 connector is connected by outward longitudinal convex and concave 58 in a light string 1, and a male part 71 connector is connected by outward horizontal convex and concave 57 in a light string1. FIG. 9C is showing an exploded view of another type of connectors 7 is a light string 1, in which a female part 72 connector is connected by outward horizontal convex and concave 57 in a light stringh1 and a male part 71 connector is connected by insulating conducting wire 31 to an end connector 78. There are female connecting terminal 76 and male connecting terminal 75 in the male part 71 and female part 72 connectors respectively.

Figure 10A:
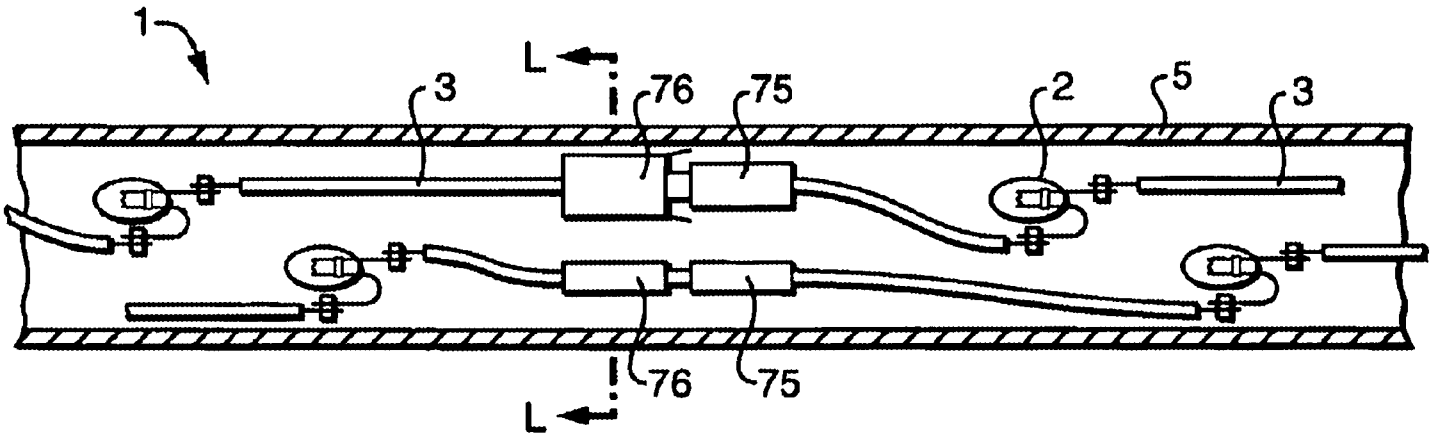
FIG. 10A is showing the light strings with connectors within the insulators.
Figure 10B:
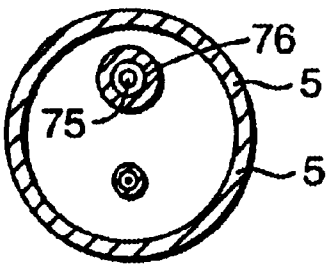
FIG. 10B is showing a cross-section view of FIG. 10A in L—L line.

FIGS. 10, 10A–10B are showing a further type of the connectors 7 in the light strings 1 within an insulator 5. FIG. 10A is showing the connectors 7 is a light string within an insulator 5, in which electrical conductors 3 a re respectively connected to female connecting terminal 76 and male connecting terminal 75 of the connector. FIG. 10B is a cross-section view-of FIG. 10A in L—L line, in which, the male connecting terminal 76 in a light string 1 within an insulator 5.

FIGS. 11, 11A–11D are perspective view of a light string 1 with

Figure 11A:
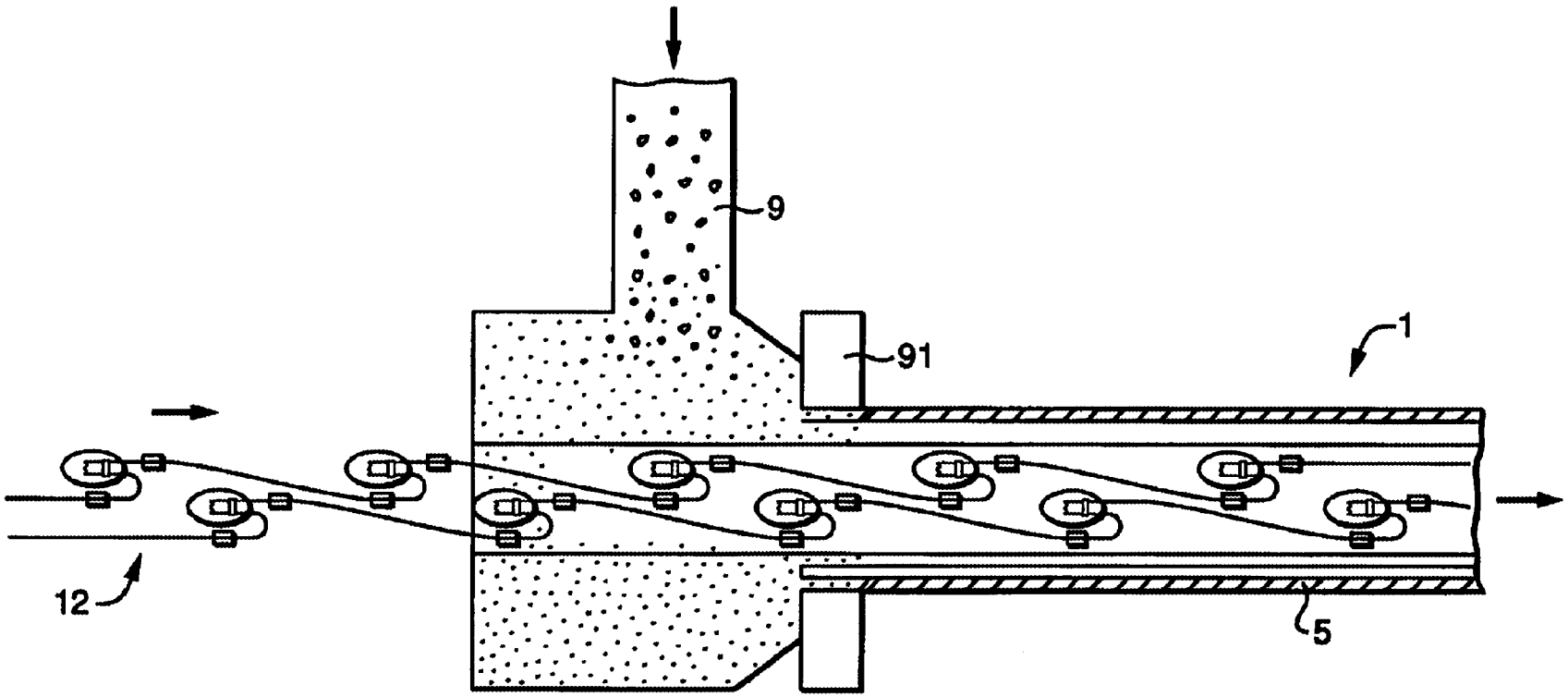
FIG. 11A is a perspective view of light strings and extruder of the present invention.
Figure 11D:
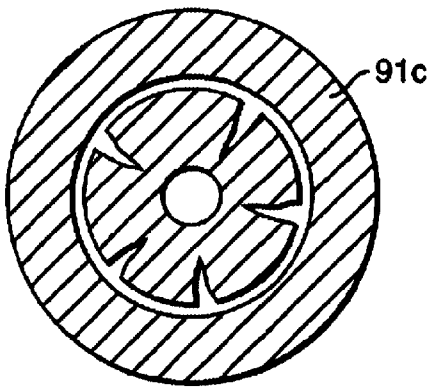
FIG. 11D is showing a cross-section view of hollow insulating body with an extension strip.
Figure 11C:
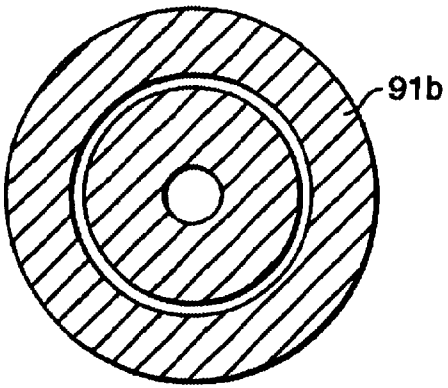
FIG. 11C is showing a cross-section view of hollow insulating body.
Figure 11B:
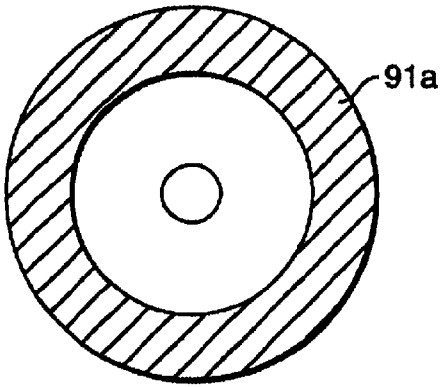
FIG. 11B is showing a cross-section view of solid insulating body.

FIGS. 11, 11A–11D are perspective view of a light string 1 with insulator. FIG. 11A is showing a perspective view of light strings 1 with multi-loops light string 12. The light strings 1 enter an extruder 9 and via die 91 to extrude out of the extruder 9 to form a flexible direction light string 1 with insulator 5. FIG. 11B is a cross-section view with solid insulating body 91*a* of light string 1 in FIG. 11A. FIG. 11C is a cross-section view with hollow insulating body 91*b* of light string 1 in FIG. 11A. FIG. 11D is a cross-section view with hollow insulating body with an extension strip 91C of light string 1 in FIG. 11A.

The positioning device can be formed of, or include, a material to store energy received as light from the luminaries and the environment, and to continue to emit light after the luminaries cease to emit light.

The feature and preferred embodiments of the prevention invention have been described in foregoing specification. The invention intended to be protected herein is net to be constructed as limited to the particular form disclosed. Variations and changes which may be made by those skilled in the art are without departing from the scope of the present invention.

What I claimed is:

1. A flexible decorative light string comprising:

multiple luminaries connected with multiple electrical conductors in one of a series arrangement, a parallel arrangement, and a series and parallel arrangement to form grouped light strings, by means of a positioning device extending along a predetermined length for multiple luminaries to separate or to fix the light strings in a certain position;

an insulator along with said grouped light strings extending in a longitudinal direction of said light strings to contain and seal the luminaries and the electrical conductors within said insulator, the luminaries and the electrical conductors being isolated from an outside environment and along with said insulator forming a flexible decorative light string with one or both ends of said string connected to connectors to form a circuit loop, wherein the positioning device has an ability to store energy received as light from the luminaries and the environment, and to continue to emit light after the luminaries cease to emit light.

2. A flexible decorative light string as claimed in claim 1:

wherein the positioning device has a fixing article to fix the electrical conductors and luminaries in a certain position to prevent the electrical conductors and luminaries from being bent causing a short circuit.

3. A flexible decorative light string as claimed in claim 2:

wherein the fixing article is formed of soft thermosetting tube, said thermosetting tube fixing the electrical conductors and said thermosetting tube fixing the luminaries individually or jointly by being heated and contracted to tightly fix in position said electrical conductors and said luminaries.

4. A flexible decorative light string as claimed in claim 2:

wherein the fixing article is soft adhesive tape, and the electrical conductors and the luminaries are twisted and wound individually or jointly by said tape and fixed in position by said tape.

5. A method for the preparation of a flexible decorative light string, comprising:

forming a string of multiple luminaries connected to multiple electrical conductors to form a circuit loop of a single loop light string;

combining together single loop light strings in one of series and parallel to form one of single and multiple circuit loops of grouped light strings; and extrusion molding plastic with an extruder to make a grouped light string sealed within insulting plastic via a predetermined die of said extruder forming a flexible decorative light string with an outward insulating body;

passing the light string through a die of an extruder, applying an outward insulating body sealing the light string within, wherein the extruder is being used to heat plastic and melt said plastic for extrusion about the light string in a cross sectional shape of the flexible decorative light string:

using dies with different shapes to extrude a hollow or solid insulating body having several reflector strips in a longitudinal direction connected to the inner wall of said insulating body.

6. A method for the preparation of a flexible decorative light string as claimed in claim 5:

further comprising twist winding the single loop light string with non-electrical lines to increase the string strength.

7. A light string arrangement comprising:

a transparent tube;

a plurality of light strings arranged in said transparent tube and extending axially along said transparent tube;

a positioning device arranged in said transparent tube, said positioning device with said transparent tube defining a plurality of chambers extending axially along said transparent tube, each of said plurality of light strings being arranged in a separate one of said chambers.

8. An arrangement in accordance with claim 7, wherein:

each of said light strings includes a plurality of luminaries connected with a plurality of electrical conductors.

9. An arrangement in accordance with claim 8, wherein:

said plurality of electrical conductors are uninsulated;

said positioning device and said transparent tube are insulators, said positioning device and said transparent tube electrically separate each of said plurality of light strings.

10. An arrangement in accordance with claim 7, wherein:

said positioning device has an ability to store energy received as light from said plurality of light strings and a surrounding environment, and to continue to emit light after said plurality of light strings cease to emit light.

11. An arrangement in accordance with claim 7, further comprising:

a function controller connected to each of said light strings to make individual light strings to form various functions pre-determined in said controller.

12. An arrangement in accordance with claim 7, wherein:

said positioning device is transparent.

* * * * *